United States Patent [19]

Ecklin

[11] 4,408,249

[45] Oct. 4, 1983

[54] TOTALLY ENCLOSED SURGE ARRESTER

[75] Inventor: Gaston Ecklin, Wettswil, Switzerland

[73] Assignee: BBC Brown, Boveri & Company, Ltd., Baden, Switzerland

[21] Appl. No.: 324,392

[22] PCT Filed: Feb. 26, 1981

[86] PCT No.: PCT/CH81/00022

§ 371 Date: Nov. 17, 1981

§ 102(e) Date: Nov. 17, 1981

[87] PCT Pub. No.: WO81/02812

PCT Pub. Date: Oct. 1, 1981

[30] Foreign Application Priority Data

Mar. 19, 1980 [CH] Switzerland ..... 2148/80

[51] Int. Cl.[3] ..... H01T 5/04

[52] U.S. Cl. ..... 361/127

[58] Field of Search ..... 361/126, 127, 128, 130; 174/73 R, 143

[56] References Cited

U.S. PATENT DOCUMENTS

| | | | |
|---|---|---|---|
| 1,935,820 | 11/1933 | Scott et al. | 174/73 R |
| 2,219,910 | 10/1940 | Webb et al. | 174/73 R |
| 2,939,976 | 6/1960 | Manni | 174/73 R |

FOREIGN PATENT DOCUMENTS

| | | | |
|---|---|---|---|
| 509926 | 3/1952 | Belgium | 174/143 |
| 888132 | 8/1953 | Fed. Rep. of Germany | 361/126 |
| 54-66443 | 5/1979 | Japan | 361/127 |

*Primary Examiner*—Harry E. Moose, Jr.

*Attorney, Agent, or Firm*—Burns, Doane, Swecker & Mathis

[57] ABSTRACT

In the case of a surge arrester, enclosed in an electrically conductive, grounded enclosure, and having disc-shaped arrester elements (2), stacked one above another to form at least one column, and having screening and controlling bodies in order to produce a linear potential-distribution along the active portion (3), the object is to achieve a good distribution of the electric field by simple means, even in the case of surge arresters which are built in small series. This object is achieved by providing electrically conducting coatings (6), as the screening and controlling bodies, these coatings being electrically insulated from each other and being wound into a body (5), composed of insulating material, and surrounding the active portion (3) of the arrester approximately concentrically. These coatings (6) are located parallel to the column-axis of the active portion (3), and are offset with respect to each other, at their ends which face away from that side of the active portion (3) which carries the high voltage, in a manner such that the coatings (6) form a flight of steps on their inner sides, which face the active portion (3). In the case of a surge arrester of this type, it is possible to linearize the voltage-drop along the active portion (3), at low cost, so that it is not only possible to manufacture the surge arrester at a favorable cost, but the surge arrester is, moreover, distinguished by an extremely small space requirement. In this context, an additional advantage derives from the fact that it is possible, in the manufacture of surge arresters of this type, to have recourse, in part, to techniques which are employed in the construction of lead-ins for capacitors.

2 Claims, 2 Drawing Figures

TOTALLY ENCLOSED SURGE ARRESTER

FIELD OF THE INVENTION

The invention relates in general to surge arresters, and in particular to surge arresters enclosed in an electrically conductive, grounded enclosure and having a columnar active portion formed by a stack of disc-shaped arrester elements, and screening and controlling elements to produce a linear potential-distribution along the active portion of the arrester.

BACKGROUND OF THE INVENTION

An arrester having the aforementioned configuration is disclosed, for example, in the article "Reliability and Application of Metal Oxide Surge Arrestors for Power Systems," by S. Tominaga et al, IEEE Transactions on Power Apparatus and Systems, Vol. PAS-98, No. 3 (1979), in particular beginning with page 809. In the Tominaga et al arrester, a linear potential-distribution along its active portion and a good dielectric strength are achieved by means of an electrically conducting shield which is connected to an element conducting the high voltage and extends along the arrester elements, as well as by means of screening rings. Considerable costs are associated with the construction of arresters of this type. Furthermore, the shape and dimensions of the screening and controlling bodies can be determined only with the aid of relatively complicated measurements and computation procedures. High manufacturing costs must accordingly be expected, especially in cases involving the building of arresters in small series.

SUMMARY OF THE INVENTION

The object of the invention is to produce an arrester of the type initially mentioned, in which a linear potential-distribution along its active portion and an optimum dielectric strength are achieved by simple means, and which, furthermore, can be manufactured in an economical manner, even when small series are involved.

This object is achieved in accordance with the present invention by a surge arrester in which the screening and controlling bodies comprise electrically conducting coatings disposed in a body composed of insulating material. The coatings are offset with respect to each other, are parallel to the column-axis of the active portion, and surround the active portion substantially concentrically. Further, the coating which is located at the shortest distance from the active portion is disposed opposite that part of the active portion which is at high potential and the coating which is located at the largest distance from the active portion is disposed opposite that part of the active portion which is at ground potential. In addition, the insulating body is externally configured, at least partially, as a truncated cone, and internally defines channels, extending along the active portion, through which the insulating gas circulates to carry away any heat which may occur at the active portion. Further, the distances between adjacent coatings advantageously are identical and the lengths of adjacent coatings decrease with increasing distance from the part of the active portion which is at high potential.

In the case of the arrester according to the invention, the numerical design of the coatings which act as controlling and screening bodies can be accomplished very precisely at a low cost. A high degree of linearization of the potential-distribution along the active portion of the arrester is achieved, by simple means, as a result of the finely gradated arrangement of the coatings. This means that the dimensions of the arrester can be minimized and electric field patterns are not needed for determining the potential-distribution.

In accordance with the invention, a degree of linearization is achieved with as few as 10 coatings, which is sufficient for the majority of arresters, whereas an arrester having 50–150 coatings is distinguished by a virtually linear degradation of the potential. By disposing the coating which is located at the shortest distance from the active portion of the arrester opposite that portion of the arrester which is at the high potential, the surge arrester according to the invention exhibits particularly low stray capacitances in the critical high-voltage region. Advantageously the coatings are incorporated into the insulating body in wound sheet form, which allows the winding technique used in the manufacture of capacitor lead-ins to be applied in the winding operation to produce the body composed of insulating material. It is further possible, if appropriate, to utilize the wound body of insulating material as a tensioning element for bracing the arrester elements of the active portion.

BRIEF DESCRIPTION OF THE DRAWING

In the detailed description which follows, illustrative embodiments are described in order to explain the invention in more detail with reference to the drawing, in which.

In the Figures, equivalent elements are marked with the same reference numbers.

DETAILED DESCRIPTION OF PREFERRED EMBODIMENTS

Figure 1:
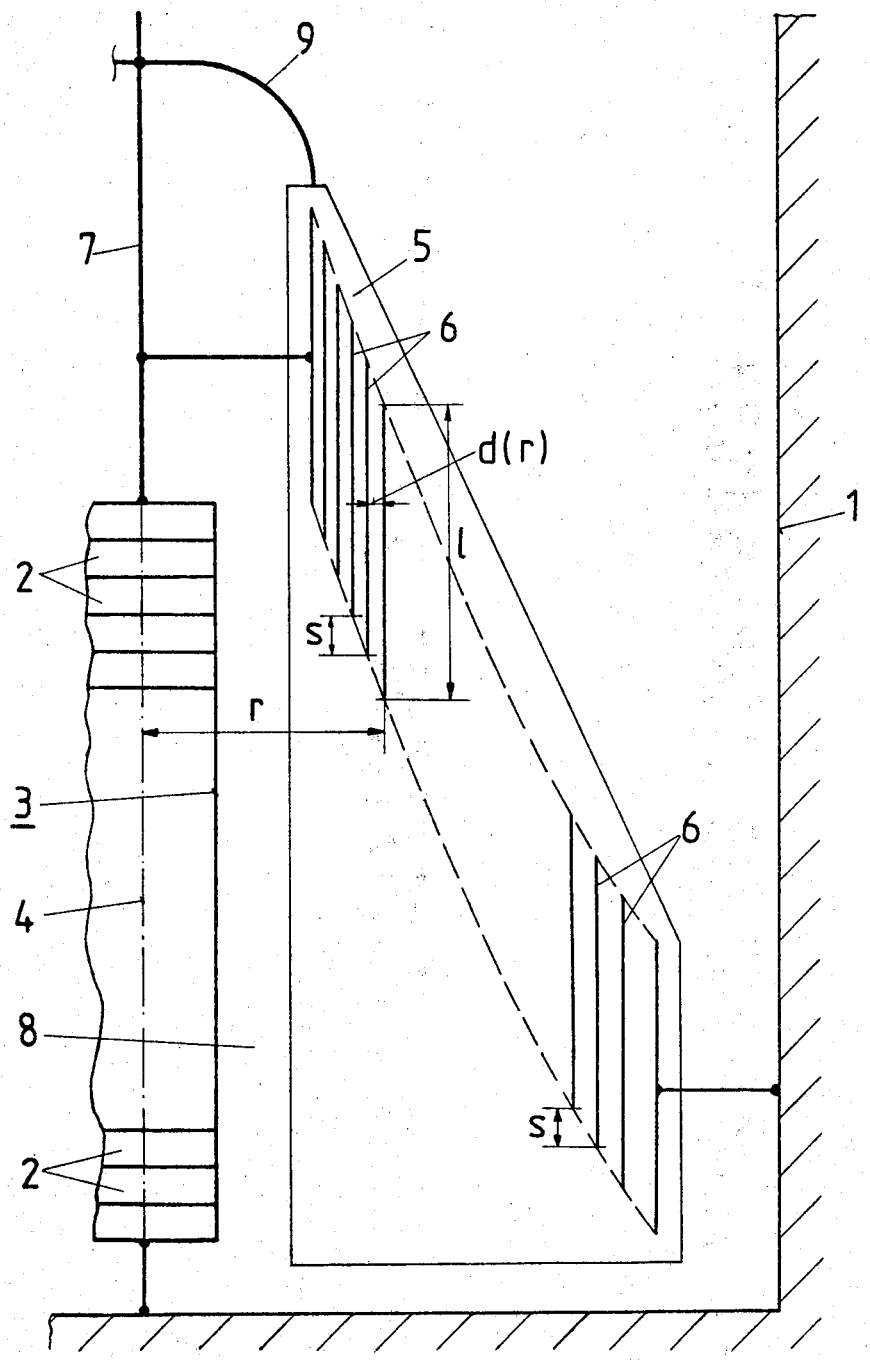
FIG. 1 is a longitudinal cross-sectional view through part of an arrester according to the invention, wherein the coatings are of uniform axial length and exhibit steps of uniform width but wherein adjacent coatings are separated from one another by distances which increase in the outward direction.

Referring to the Figures, a surge arrester constructed in accordance with the present invention comprises resistance-discs 2 which have cylindrical symmetry and contain zinc oxide. Resistance-discs 2 are stacked, one above another, in a columnar manner, the lowest disc being connected to ground and the uppermost disc being connected to the high voltage 7. Discs 2 form the elements of the active portion 3 of the surge arrester, and are located in the interior of a sealed metallic enclosure 1, which is filled with an insulant, such as gaseous sulfur hexafluoride ($SF_6$) or nitrogen (not shown). A rotationally (axially) symmetrical insulating body 5 is located between the discs 2 and the sealed enclosure 1. Body 5 contains electrically conducting coatings 6, which are electrically insulated from each other, and are located parallel to the column axis 4 of the active portion 3 of the arrester and surround the portion 3 concentrically. Channels 8 are provided, extending axially along the active portion 3, between the portion 3 and the insulating body 5, which allow the insulant to circulate through these channels and to carry away any heat which may be generated at the active portion 3. A screening electrode 9, connected to the high potential, homogenizes the electric field of the inner-most coatings 6, which are located in the region of the high potential 7.

Figure 2:
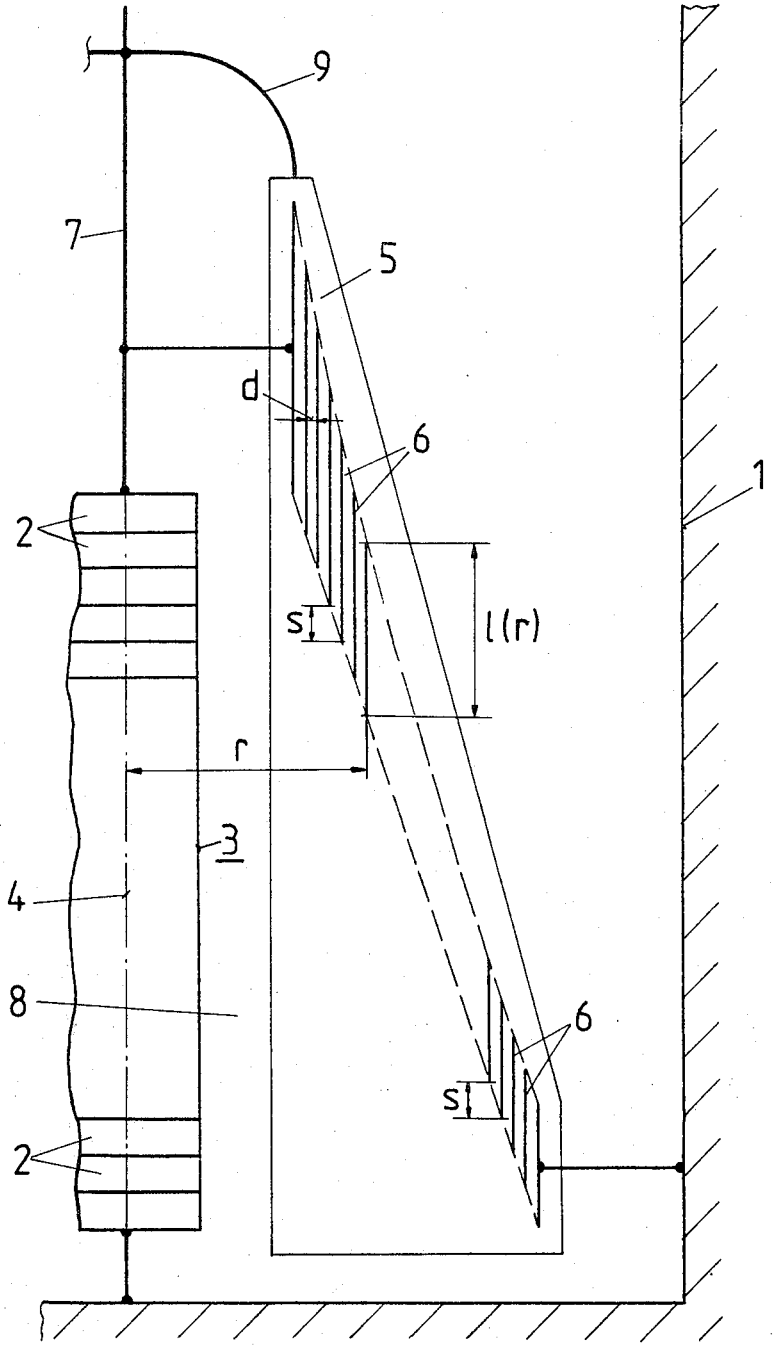
FIG. 2 is a longitudinal cross-section view through part of an arrester according to the invention, wherein the distances between the coatings are identical and the coatings exhibit steps of uniform width, but wherein the axial extent of adjacent coatings progressively decreases in the outward direction.

The coatings 6, which have a capacitive effect, are disposed in the insulating body 5 in such a manner that the voltage between the high potential 7 and ground is linearly degraded along the active portion 3. This is achieved by arranging the coatings 6 in a staggered manner such that inner end surfaces, i.e., the end surfaces relatively nearer to active portion 3 and facing away from the high voltage end of active portion 3, are offset with respect to each other by a suitable step-width s, as shown. The elementary capacitances between adjacent coatings 6 are suitable determined by the correct choice of the distance d between coatings, the length l of the coatings, and the radial distance r of these coatings from axis 4, while also taking into account the stray capacitances. As shown, the coatings 6 are staggered to form an outwardly extending flight of steps which are closest to the active portion 3 adjacent the end of portion 3 which carries the high voltage. The coating which is located at the shortest distance from the active portion 3, adjacent the end of portion 3 which carries the high voltage, is connected to the high potential 7, while the coating located at the greatest distance from the active portion 3, adjacent the end of active portion 3 which is grounded, is connected to ground. Easily obtainable potential-distributions along the active portion 3 result either when the width s of the steps and, as in FIG. 1, the length l of the coatings 6 are, in each case, constant in the axial direction, and when the step-height d, determined in the radial direction by the distance between two adjacent coatings 6, increases in the outward direction, or when, as in FIG. 2, the step-height d is constant and the length l of adjacent coatings decreases in the outward direction.

The coatings 6, which surround the active portion 3, do not need to form a closed conductive annulus. It has thus proved particularly expedient to wind the coatings sequentially with an insulating material in sheet form, such as hard paper or soft paper having a thickness of approximately 0.1 mm, or with some other insulating plastic. In doing so, the coatings are inserted in the form of thin metal foils, or are imprinted as a conducting layer having a thickness of a few $\mu$m. In general, the wound body 5, composed of insulating material, is of cylindrical symmetry. In order to minimize the capacitances to ground, it is, however, advantageous to remove a portion of the body 5 between the coating 6 and the enclosure 1, so that the body 5 is externally configured, at least partially, as a truncated cone, as can be seen from the Figures. As a result of the winding technique, the coatings 6 do not exhibit rigorous rotational symmetry about the column-axis 4, but become wider, in a spiral pattern corresponding to the foil thickness. This deviation from cylindrical symmetry can, nevertheless, be disregarded, since the distance between the coating 6 and the active portion 3 is several orders of magnitude greater in comparison to the layer thickness of the coatings, as represented by the foil. The winding technique not only enables, in a simple manner, the coatings 6 to be fixed inside the body 5, composed of insulating material, but also allows the step-height d to be varied, in a simple way, by multiple-turn winding of the foils.

Arrester-elements 2 without spark-gaps, such as, for instance, resistors containing zinc oxide, are particularly suitable for the surge arresters according to the invention, but it is also possible to employ active parts containing spark-gaps.

I claim:

1. A surge arrester comprising an electrically conductive, grounded enclosure filled with an insulating gas in which are disposed disc-shaped active arrester elements arranged one above another to form at least one columnar active portion which is connected between a high potential and a ground potential, and screening and controlling bodies for producing a linear potential distribution along said columnar active portion of the arrester, said screening and controlling bodies comprising electrically conducting coatings disposed in a body composed of insulating material, wherein the coatings are offset with respect to each other, are parallel to the column-axis of said active portion, and surround said active portion substantially concentrically, wherein the coating which is located at the shortest distance from said active portion is disposed opposite that part of said active portion which is at high potential and the coating which is located at the largest distance from said active portion is disposed opposite that part of said active portion which is at ground potential, and wherein said insulating body is externally configured, at least partially, as a truncated cone, and internally defines channels, extending along said at least one active portion, through which the insulating gas circulates, thereby carrying away any heat which may occur at the active portion.

2. The surge arrester of claim 1 wherein the distances between adjacent coatings are identical and the lengths of adjacent coatings decrease with increasing distance from said part of said active portion which is at high potential.

* * * * *